US011002064B2

(12) United States Patent
Hall et al.

(10) Patent No.: US 11,002,064 B2
(45) Date of Patent: May 11, 2021

(54) SYSTEM FOR REVERSIBLY DIVIDING A SPACE

(71) Applicant: Hall Labs LLC, Provo, UT (US)

(72) Inventors: David R Hall, Provo, UT (US); Benjamin Jensen, Orem, UT (US); Alexa Goodman, Provo, UT (US); Jeffrey Knighton, Provo, UT (US); Matthew Raun, Provo, UT (US); Scott Tew, Provo, UT (US); Nathan Cowley, Provo, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/531,016

(22) Filed: Aug. 3, 2019

(65) Prior Publication Data

US 2021/0032856 A1 Feb. 4, 2021

(51) Int. Cl.
*E06B 3/92* (2006.01)
*E04B 1/343* (2006.01)

(52) U.S. Cl.
CPC ..... *E06B 3/925* (2013.01); *E04B 1/34363* (2013.01)

(58) Field of Classification Search
CPC ..... E04B 1/34363; E05D 15/18; E05D 15/24; E05D 15/262; E05Y 2800/122; E05Y 2900/132; E05F 17/00; E06B 3/925; E06B 3/927
See application file for complete search history.

(56) References Cited

U.S. PATENT DOCUMENTS 1,238,704 A * 8/1917 Wendelken ..... E06B 3/44 49/125
2,707,311 A * 5/1955 Orlin ..... E06B 9/0638 49/125
2,850,089 A * 9/1958 Burke ..... E06B 3/922 160/202
2,908,051 A * 10/1959 Sparkes ..... E06B 3/925 49/125

(Continued)

FOREIGN PATENT DOCUMENTS

FR 2891561 A1 * 4/2007 ..... E04D 13/0358

OTHER PUBLICATIONS

Machine translation of foreign reference FR2891561, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2891561&SRCLANG=fr&TRGLANG=en (last accessed on Sep. 3, 2020) (Year: 2020).*

*Primary Examiner* — Theodore V Adamos

(57) ABSTRACT

A system for reversibly dividing a space is disclosed. A first panel consists of a first vertical member and a first horizontal member attached perpendicular to a bottom end of the first vertical member and extends away from the first vertical member towards a second panel. The second panel consists of a second vertical member and a second horizontal member attached perpendicular to a top end of the second vertical member and extends away from the second vertical member towards the first panel. The first and second panel can be stored in an overhead position. The space is reversibly divided when the first panel and the second panel are lowered. The first panel is lowered such that the first panel forms a top portion of a wall. The second panel is lowered until the second horizontal member rests on the first horizontal member, forming a bottom portion of the wall.

8 Claims, 5 Drawing Sheets

(56) References Cited

U.S. PATENT DOCUMENTS

| | | | | | |
|---|---|---|---|---|---|
| 3,204,691 | A * | 9/1965 | Rohrman | E06B 9/0638 | 160/202 |
| 3,304,994 | A * | 2/1967 | Kozak | E06B 9/0638 | 160/202 |
| 3,313,338 | A * | 4/1967 | Knight | E06B 3/925 | 160/189 |
| 4,938,273 | A * | 7/1990 | Dubbelman | E06B 9/0692 | 160/201 |
| 5,549,150 | A * | 8/1996 | Williams | E06B 7/082 | 160/201 |
| 6,141,907 | A * | 11/2000 | Parazader | E04D 13/0358 | 49/120 |
| 6,860,311 | B1 * | 3/2005 | Minor | E05D 15/18 | 160/193 |
| 2004/0003556 | A1 * | 1/2004 | Zerbst | E05D 15/0643 | 52/220.7 |
| 2004/0049984 | A1 * | 3/2004 | Pfaff | E05F 17/00 | 49/116 |

* cited by examiner

SYSTEM FOR REVERSIBLY DIVIDING A SPACE

TECHNICAL FIELD

The systems described herein relate generally to dividing spaces.

BACKGROUND

Modular office and home spaces are becoming more and more common. These spaces are convertible between different uses. A major challenge for modular spaces is separation of the spaces. Systems for effectively separating spaces are required.

SUMMARY

In a first aspect, the disclosure provides a system for reversibly dividing a space. A first panel consists of a first vertical member and a first horizontal member. The first horizontal member is attached perpendicular to a bottom end of the first vertical member and extends away from the first vertical member towards a second panel. The second panel consists of a second vertical member and a second horizontal member. The second horizontal member is attached perpendicular to a top end of the second vertical member and extends away from the second vertical member towards the first panel. The first panel and the second panel can be stored in an overhead position. The space is reversibly divided when the first panel and the second panel are lowered. The first panel is lowered such that the first panel forms a top portion of a wall. The second panel is lowered until the second horizontal member rests on the first horizontal member, forming a bottom portion of the wall.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 2:
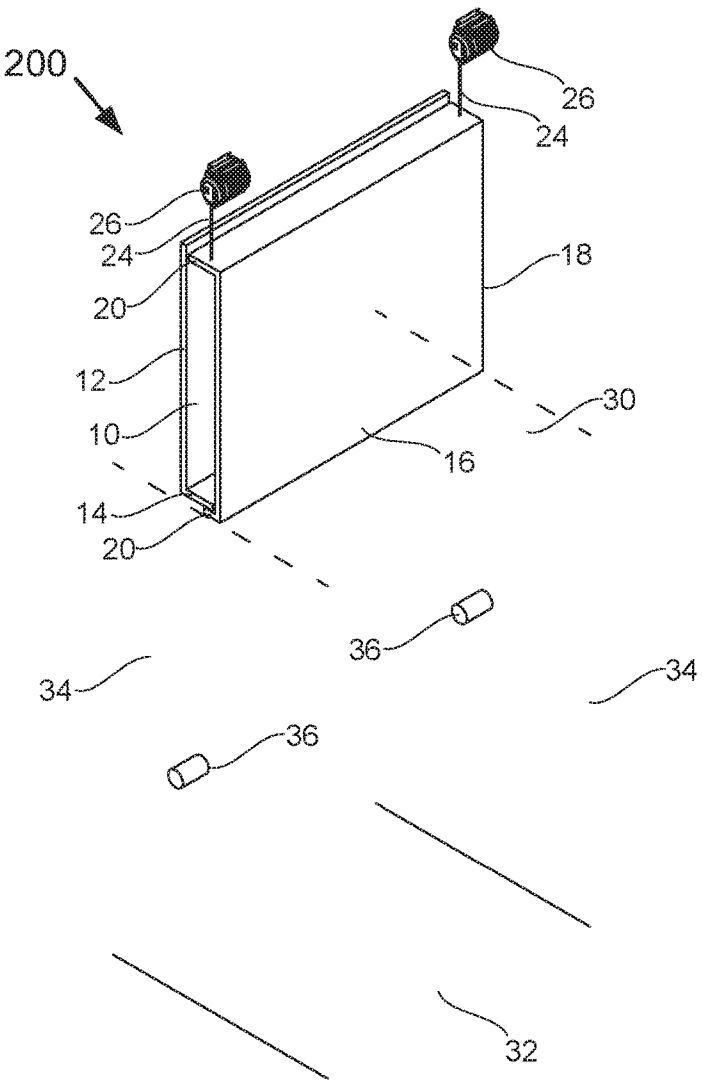
FIG. 2 is an isometric top, front, side view of the divider system of FIG. 1.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "panel" is meant to refer to a cuboid of homogenous or non-homogenous material used as at least a partial divider of a space.

As used herein, "track" is meant to refer to is a strip of material formed so as to allow movement along a given path in a consistent manner.

As used herein, "track follower" is meant to refer to a small piece of material that is attached to a panel and rides in the track. A track follower keeps the panel material in line with the track and forces the panel to follow the path set by the track as the track follower moves along the track.

As used herein, "divider" is meant to refer to the panels used to the divide the space.

As used herein, "overhead position" is meant to refer to any space above the space to be divided. Preferably, this space will be above the ceiling, but is not restricted to this.

As used herein, "line" is meant to refer to any device or material that is long, cylindrical, thin, flexible, and having a high tensile strength. Preferably, this will be a braided wire, but ropes, cords, string, twine, cable, strand, chains and combinations thereof may be used as well.

As used herein, "gasket" is meant to refer to any material used to make a seal between two abutting surfaces. Gaskets may also be sound dampeners.

The disclosed invention consists of a divider being made up of independent panels. A first panel is shaped like an "L" and a second panel like an upside-down "L" in a preferred embodiment. The panels are raised and lowered to either allow a space to be combined or to separate the space. The first panel forms a top half of the wall and the second panel forms the bottom half of the wall. The side bar of the upside-down "L" rests on the side bar of the "L" when they are deployed.

The invention allows for a modular use of space. One advantage of this technology is removing the storage of the non-deployed wall or panels from the floor or side of the room into an overhead storage space.

In an office environment, a conference room could be divided into temporary offices for visiting executives or an interview room with an adjacent observation room. The system could be installed in a large, open, office space where smaller offices, half-walled cubicles, conference rooms, interview rooms, and break rooms could be added and removed as needed. In a law-enforcement office with limited space, a temporary interrogation room with attached observation room could be formed from a room that is normally used as a briefing or conference room by deploying a set of panels where an upper panel is made from a one-way mirror material. In case of modular living and work space, the panels could be kept in the ceiling during the work day and lowered to enclose individual rooms for occupancy at night in conjunction with other modular means of changing the furniture in the room automatically.

Another commercial application would be in hotels, hostels, or other lodgings. With this technology, rooms could be made larger and smaller as desired by the guest.

In a domestic environment, this could be used to create a temporary office, room, closet, or bedroom that the home only needs sporadically. This could be used in a micro-home to create smaller, multi-use spaces out of a main living space.

Figure 1:
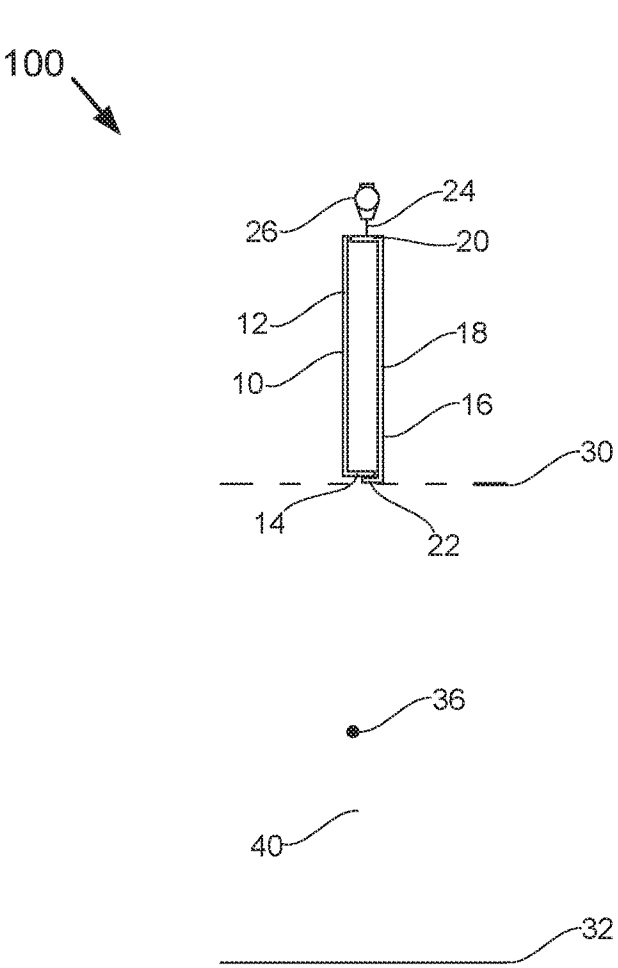
FIG. 1 is a side elevation view of a divider system stored in an overhead position.
Figure 4:
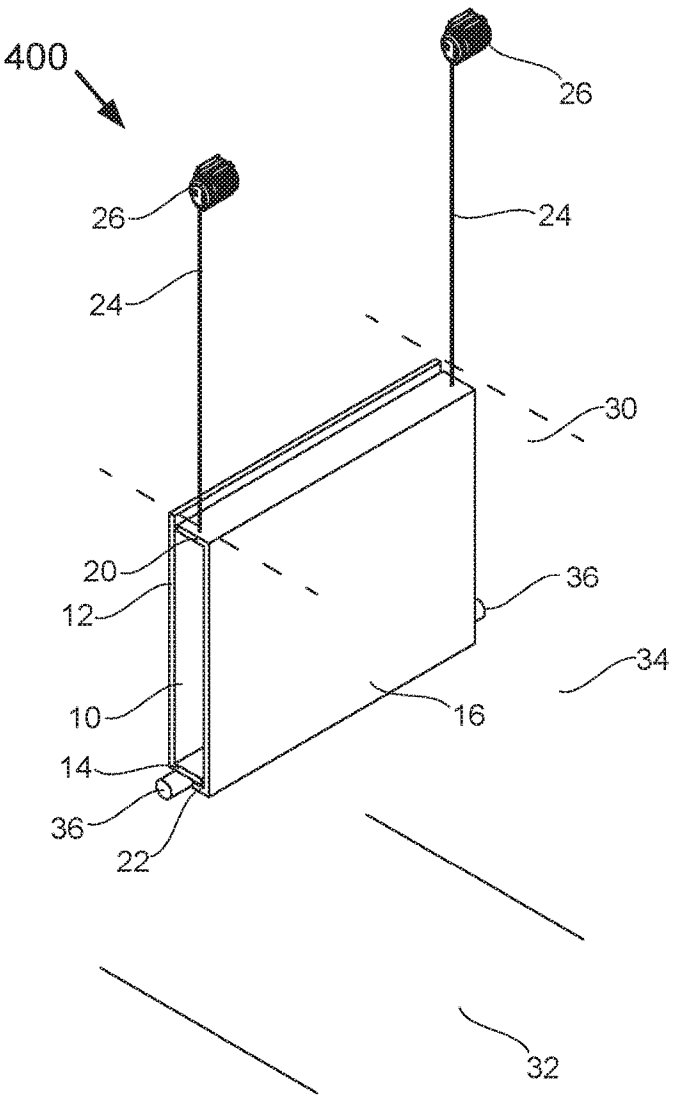
FIG. 4 is an isometric top, front, side view of the divider system of FIG. 3.
Figure 3:
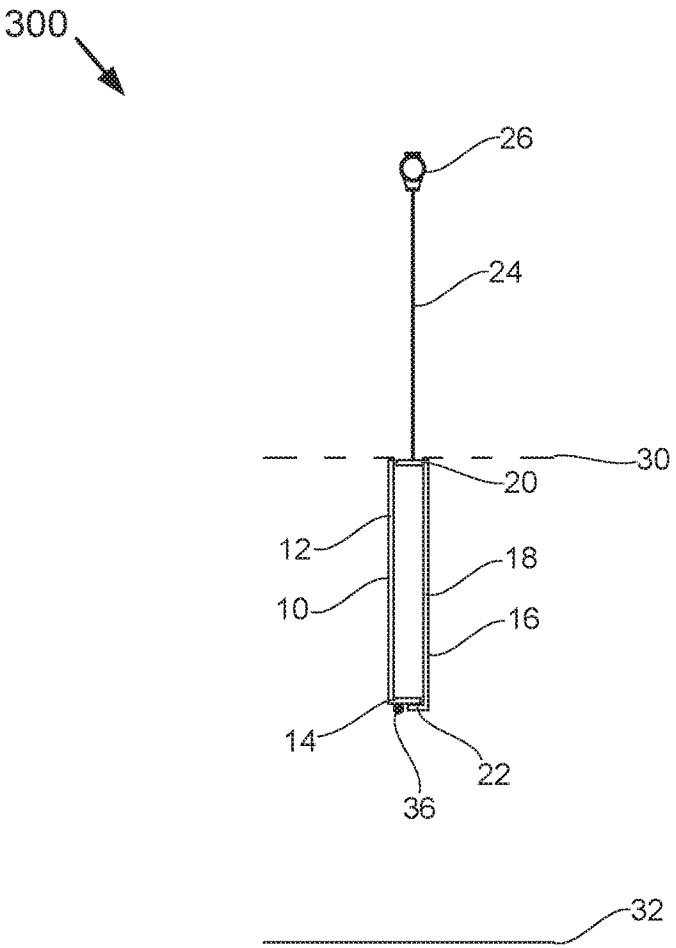
FIG. 3 is a side elevation view of the divider system of FIG. 1 in a partially-deployed position.
Figure 6:
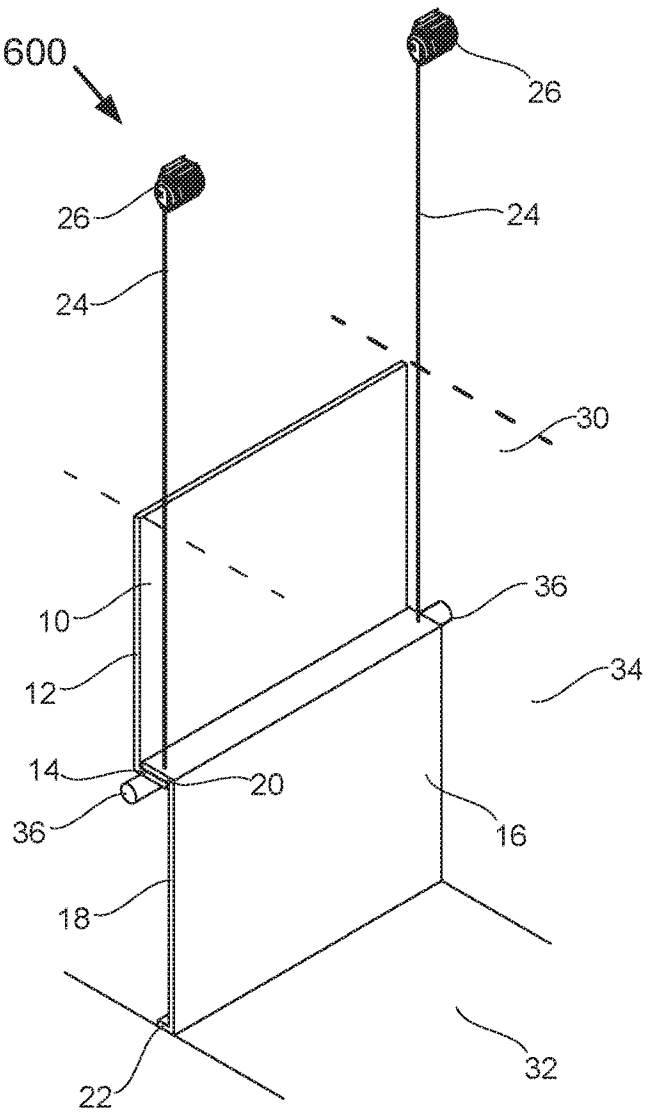
FIG. 6 is an isometric top, front, side view of the divider system of FIG. 5.
Figure 5:
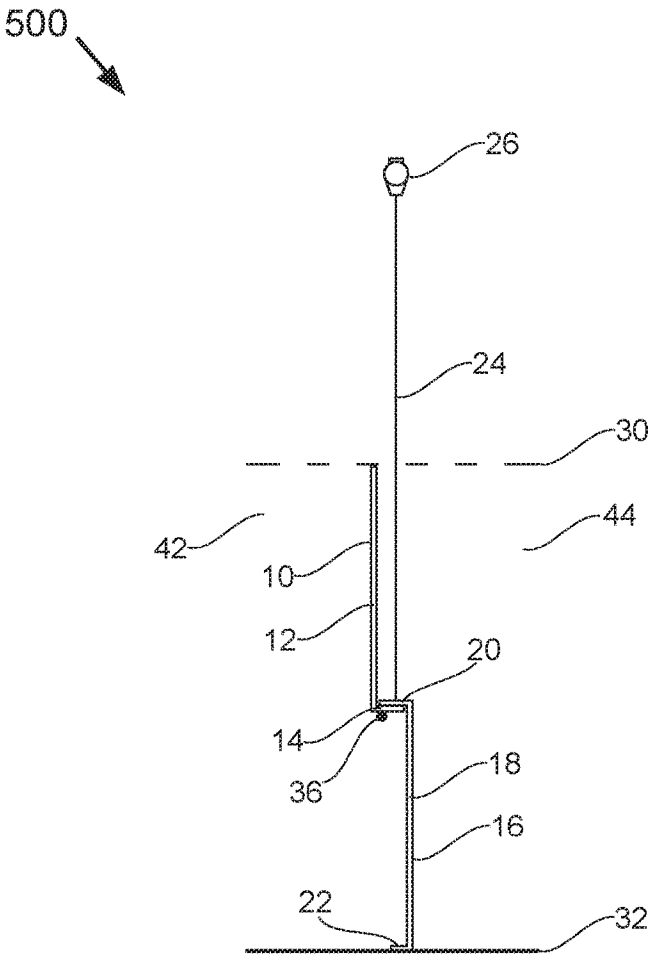
FIG. 5 is a side elevation view of the divider system of FIG. 1 in a fully-deployed position.

Now referring to the Figures, FIG. 1-6 are various views of a divider system that may be used in one embodiment of the present invention. FIG. 1 is a side elevation view of the divider system stored in an overhead position at 100. FIG. 2 is an isometric top, front, side view of the divider system of FIG. 1 at 200. FIG. 3 is a side elevation view of the divider system in a partially-deployed position at 300. FIG. 4 is an isometric top, front, side view of the divider system of FIG. 3 at 400. FIG. 5 is a side elevation view of the divider system in a fully-deployed position at 500. FIG. 6 is an isometric top, front, side view of the divider system of FIG. 5 at 600. A first panel 10 and a second panel 16 begin in an overhead position above ceiling level 30 at 100 and 200. The first panel 10 consists of a first vertical member 12 and a first horizontal member 14. The first horizontal member 14 is attached perpendicular to a bottom end of the first vertical member 12 and extends away from the first vertical member 12 towards the second panel 16. The second panel 16 consists of a second vertical member 18, a second horizontal member 20, and a third horizontal member 22. The second and third horizontal members 20 and 22 are attached perpendicular to the top and bottom ends of the second vertical member 18, respectively, and extend away from the second vertical member towards the first panel 10. The second panel 16 is held in the overhead position by lines 24 attached to winches 26. The first panel 10 is held in the overhead position by resting on the third horizontal member 22. At 300 and 400, the winches 26 extend the lines 24, lowering the first and second panels 10 and 16 until the first horizontal member 14 of the first panel 10 rests on lips 36 mounted on opposite walls 34, the first panel 10 forming the top portion of a wall. At 500 and 600, the second panel 16 continues to lower until the second horizontal member 22 rests on the floor 32, the second panel 16 forming the bottom portion of the wall. This reversibly separates the space 40 into spaces 42 and 44.

Figure 9:
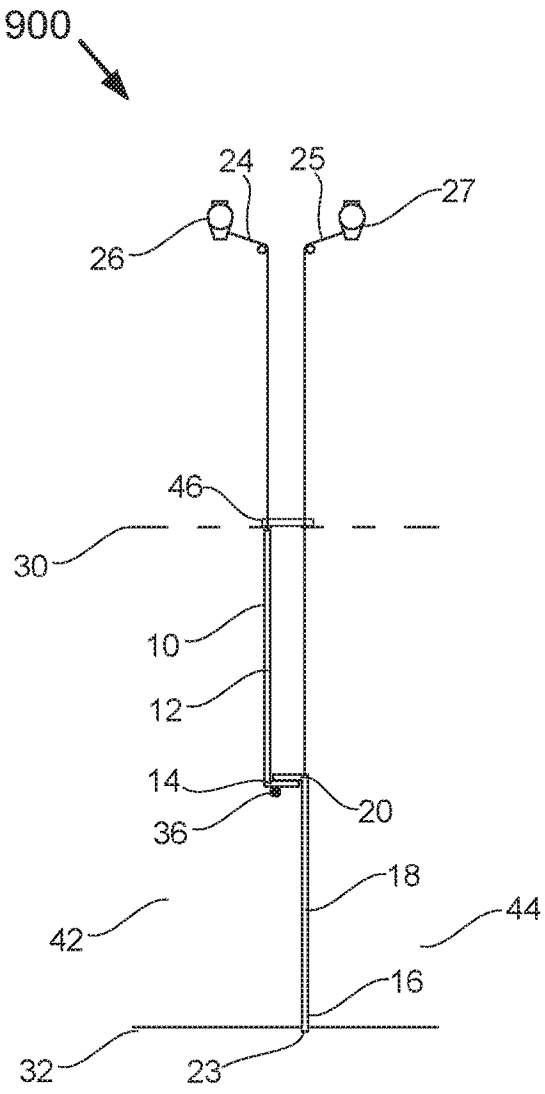
FIG. 9 is a side elevation view of the divider system of FIG. 7 in a fully-deployed position.
Figure 8:
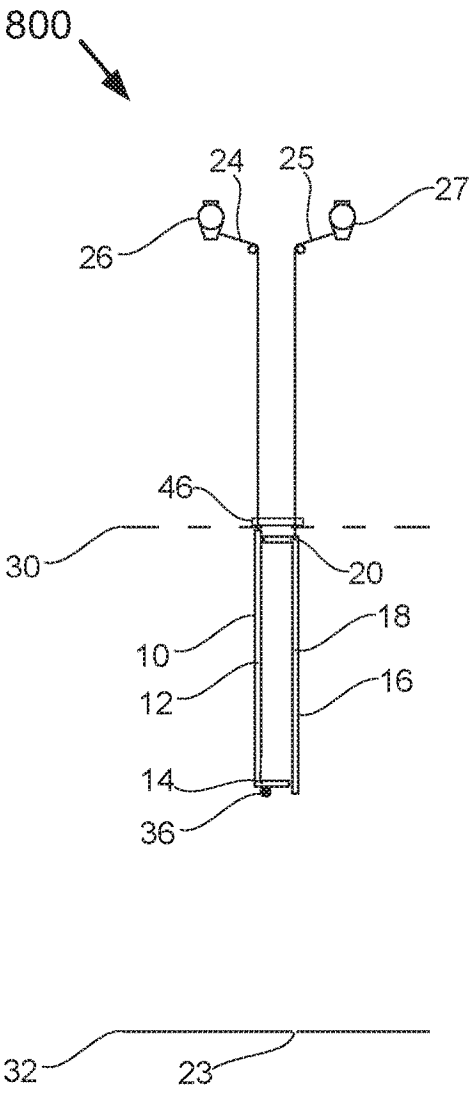
FIG. 8 is a side elevation view of the divider system of FIG. 7 in a partially-deployed position.
Figure 7:
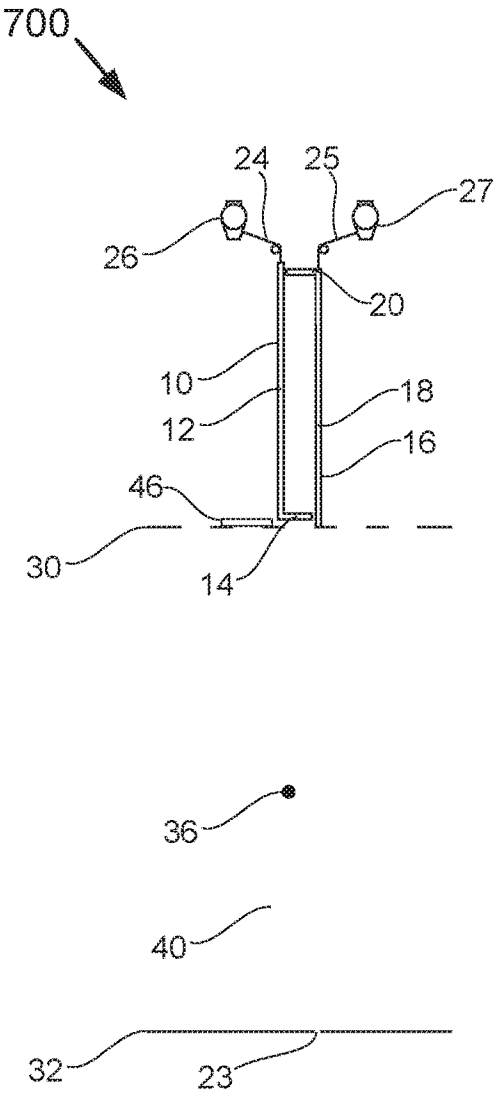
FIG. 7 is a side elevation view of a divider system stored in an overhead position.

FIGS. 7-9 are side elevation views of a divider system that may be used in one embodiment of the present invention. FIG. 7 is a side elevation view of the divider system stored in an overhead position at 700. FIG. 8 is a side elevation view of the divider system of FIG. 7 in a partially-deployed position at 800. FIG. 9 is a side elevation view of the divider system of FIG. 7 in a fully-deployed position at 900. A first panel 10 and a second panel 16 begin in an overhead position above ceiling level 30 at 700. The first panel 10 consists of a first vertical member 12 and a first horizontal member 14. The first horizontal member 14 is attached perpendicular to a bottom end of the first vertical member 12 and extends away from the first vertical member 12 towards the second panel 16. The second panel 16 consists of a second vertical member 18 and a second horizontal member 20. The second horizontal member 20 is attached perpendicular to the top end of the second vertical member 18 and extends away from the second vertical member toward the first panel 10. The first panel 10 is held in the overhead position by lines 24 attached to winches 26. The second panel 16 is held in the overhead position by lines 25 attached to winches 27. At 800, the winches 26 extend the lines 24 and 25, lowering the first and second panels 10 and 16 until the first horizontal member 14 of the first panel 10 rests on lips 36 mounted on opposite walls, the first panel 10 forming the top portion of a wall. At 900, the second panel 16 continues to lower until the second horizontal member 22 rests in a gap 23 in the floor 32, the second panel 16 forming the bottom portion of the wall. This reversibly separates the space 40 into spaces 42 and 44. The edges of the wall are sealed for sound proofing against the opposite walls and the floor 32 by rubber gaskets that the first and second panels 10 and 16 press against as they are lowered into position. The ceiling 30 seals for sound proofing by a third panel 46 sliding over the hole in the ceiling. Preferably, the seals 30 and other seals used with the invention are made of a resilient material, such rubber or other polymers.

Figures 10, 11, 12:
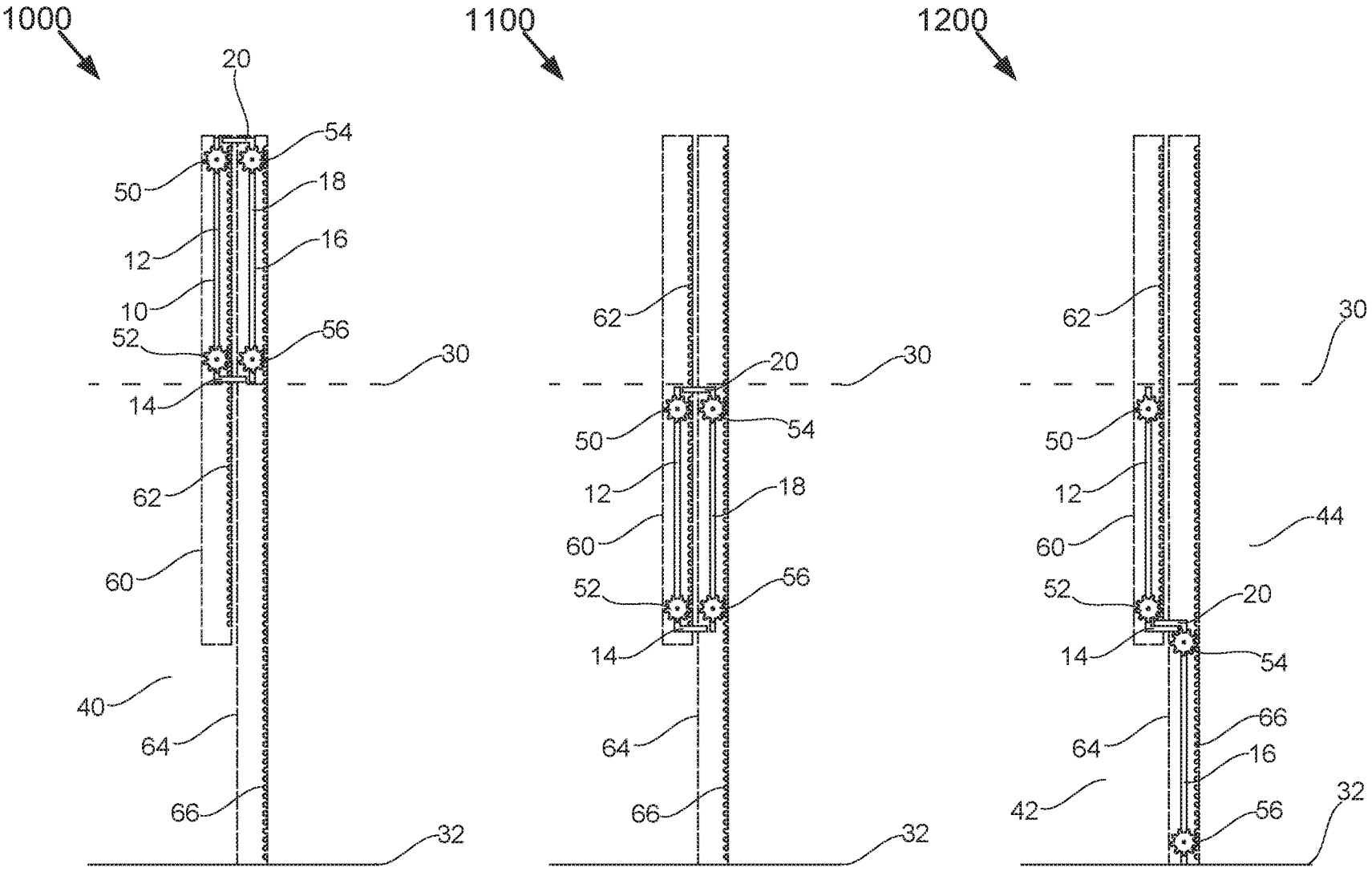
FIG. 10 is a side elevation view of a divider system stored in an overhead position.
FIG. 11 is a side elevation view of the divider system of FIG. 10 in a partially-deployed position.
FIG. 12 is a side elevation view of the divider system of FIG. 10 in a fully-deployed position.

FIGS. 10-12 are side elevation views of a divider system that may be used in one embodiment of the present invention. FIG. 10 is a side elevation view of the divider system stored in an overhead position at 1000. FIG. 11 is a side elevation view of the divider system of FIG. 10 in a partially-deployed position at 1100. FIG. 12 is a side elevation view of the divider system of FIG. 10 in a fully-deployed position at 1200. A first panel 10 and a second panel 16 begin in an overhead position above ceiling level 30 at 1000. The first panel 10 consists of a first vertical member 12, a first horizontal member 14, and pinion gears 50 and 52. The first horizontal member 14 is attached perpendicular to a bottom end of the first vertical member 12 and extends away from the first vertical member 12 towards the second panel 16. The second panel 16 consists of a second vertical member 18, a second horizontal member 20, and pinion gears 54 and 56. The second horizontal member 20 is attached perpendicular to the top end of the second vertical member 18 and extends away from the second vertical member toward the first panel 10. The first panel 10 is held in the overhead position by pinion gears 50 and 52, which travel along track 60 using teeth 62. The second panel 16 is held in the overhead position by pinion gears 54 and 56, which travel along track 64 using teeth 66. At 1100, the pinion gears 50, 52, 54, and 56 are walked down tracks 60 and 64, lowering the first and second panels 10 and 16 until the first horizontal member 14 of the first panel 10 reaches a bottom end of track 60, the first panel 10 forming the top portion of a wall. At 1200, the second panel 16 continues to lower until the second horizontal member 22 rests on the floor 32, the second panel 16 forming the bottom portion of the wall. This reversibly separates the space 40 into spaces 42 and 44.

In some embodiments, a first lip and a second lip are mounted on opposite walls or tracks adjacent to and below opposite edges of the first horizontal member, the first lip and the second lip positioned such that a bottom side of the first horizontal member rests on the first lip and the second lip when the first panel is lowered.

In some embodiments, a first line and a second line each attached to an opposite side of a top portion of the first panel and configured to raise and lower the first panel. A third line and a fourth line are attached to an opposite side of a top portion of the second panel and configured to raise and lower the second panel. The first line and the second line are attached to at least one first lifting device and the third line and the fourth line are attached to at least one second lifting device.

In some embodiments, the first panel comprises a first track follower, a second track follower, a third track follower, and a fourth track follower. The first and second track followers are each attached to an opposite side of the first panel and are each attached adjacent a bottom edge of the first panel. The third and fourth track followers are each attached to an opposite side of the first panel and are each attached adjacent a top edge of the first panel. The second panel has a fifth track follower, a sixth track follower, a seventh track follower, and an eighth track follower. The fifth and sixth track followers are each attached to an opposite side of the second panel and are each attached adjacent a bottom edge of the second panel. The seventh and eight track followers are each attached to an opposite side of the second panel and are each attached adjacent a top edge of the second panel. A first track and a second track are each on opposite sides of the space to be divided. Each runs generally straight and generally vertical and each has a top at a point overhead and a bottom at a point part-way to a floor of the space. A third and a fourth track each have a vertical portion that is adjacent and runs parallel to the respective first and second straight track and each have a top at a point overhead and a bottom at a point adjacent the floor of the space. As the first panel is lowered, the first and third track followers ride in the first track, and the second and fourth track followers ride in the second track, until the first and the third track followers reach the bottoms of the first and second tracks, respectively. As the second panel is lowered, the fifth and seventh track followers ride in the third track, and the sixth and eighth track followers ride in the fourth track, until the fifth and the seventh track followers reach the bottoms of the third and fourth tracks, respectively. In some embodiments, a first line and a second line are each attached to an opposite side of a top portion of the first panel and configured to raise and lower the first panel. A third line and a fourth line are attached to an opposite side of a top portion of the second panel and configured to raise and lower the second panel. The first line and the second line are attached to at least one first lifting device and the third line and the fourth line are attached to at least one second lifting device. In other embodiments, each of the first, second, third, and fourth tracks contain a rack of teeth and the first, second, third, fourth, fifth, sixth, seventh, and eighth track followers are driven pinion gears, configured to walk along the rack of the respective tracks, to thereby raise and lower the first and second panels.

In some embodiments, a bottom portion of the second panel attaches magnetically to the floor of the space. In some embodiments, the first horizontal member and the second horizontal member attach magnetically.

In some embodiments, a bottom portion of the second panel is shaped to interlock with a gap in a floor of the space.

In one embodiment, the first panel and the second panel consist at least partially of glass. In some embodiments, the first panel and the second panel are made of a material selected from the group consisting of plastic, metal, wood, and combinations thereof.

In some embodiments, seals are provided around a perimeter of the wall that are configured to deploy when the wall is deployed. Deployment can include sliding of the seals against the wall or inflation of a bladder. In other embodiments, gaskets are provided around the perimeter of the wall that seal the wall when deployed.

The invention has been described with reference to various specific and preferred embodiments and techniques. Nevertheless, it is understood that many variations and modifications may be made while remaining within the spirit and scope of the invention.

What is claimed is:

1. A system for reversibly dividing a space by a first panel and a second panel stored above a ceiling comprising:

the first panel comprising a first vertical member and a first horizontal member, the first horizontal member attached perpendicular to a bottom end of the first vertical member and extending away from the first vertical member towards the second panel;

the second panel comprising a second vertical member, a second horizontal member, and a third horizontal member, the second horizontal member attached perpendicular to a top end of the second vertical member and extending away from the second vertical member towards the first panel and the third horizontal member attached perpendicular to a bottom edge of the second panel and extending away from the second vertical member towards the first panel;

a first lip and a second lip mounted on opposite walls or tracks adjacent to and below opposite edges of the first horizontal member at a midpoint between the ceiling and a floor;

wherein the first panel rests on the third horizontal member while the first panel and the second panel are stored above the ceiling; and wherein the second panel is configured to be lowered to the floor, with the first panel being configured such that the first panel rests on the third horizontal member as the second panel is lowered to the floor until the first horizontal member comes into contact with and rests on the first lip and the second lip, such that the first panel separates a top half of the space and the second panel separates a bottom half of the space.

2. The invention of claim 1, wherein:

the first panel comprises a first track follower, a second track follower, a third track follower, and a fourth track follower, the first and second track followers each attached to an opposite side of the first panel and each attached adjacent a bottom edge of the first panel, and the third and fourth track followers each attached to an opposite side of the first panel and each attached adjacent a top edge of the first panel;

the second panel comprises a fifth track follower, a sixth track follower, a seventh track follower, and an eighth track follower, the fifth and sixth track followers each attached to an opposite side of the second panel and each attached adjacent a bottom edge of the second panel, and the seventh and eight track followers each attached to an opposite side of the second panel and each attached adjacent a top edge of the second panel;

a first track and a second track, each on opposite sides of the space to be divided, each running generally straight and generally vertical and each having a top at a point overhead and a bottom at a point part-way to a floor of the space;

a third and a fourth track, each having a vertical portion that is adjacent and runs parallel to the respective first and second straight track, and each having a top at a point overhead and a bottom at a point adjacent the floor of the space;

wherein as the first panel is lowered, the first and third track followers ride in the first track, and the second and fourth track followers ride in the second track, until the first and the third track followers reach the bottoms of the first and second tracks, respectively; and wherein as the second panel is lowered, the fifth and seventh track followers ride in the third track, and the sixth and eighth track followers ride in the fourth track, until the fifth and the seventh track followers reach the bottoms of the third and fourth tracks, respectively.

3. The invention of claim 1, wherein when the first panel and the second panel are stored above the ceiling, the first horizontal member rests on the third horizontal member, holding the first panel above the ceiling.

4. The invention of claim 3, further comprising a first line and a second line attached to an opposite side of a top portion of the second panel and configured to raise and lower the second panel, wherein the second panel raises and lowers the first panel.

5. The invention of claim 4, wherein the first line and the second line are attached to at least one lifting device.

6. The invention of claim 1, wherein a bottom portion of the second panel attaches magnetically to a floor of the space.

7. The invention of claim 1, wherein the first panel and the second panel comprise glass.

8. The invention of claim 1, wherein the first panel and the second panel comprise a material selected from the group consisting of plastic, metal, wood, and combinations thereof.

* * * * *